US010048619B1

(12) United States Patent
Matsushima et al.

(10) Patent No.: US 10,048,619 B1
(45) Date of Patent: Aug. 14, 2018

(54) DEVELOPING DEVICE AND IMAGE FORMING APPARATUS

(71) Applicant: FUJI XEROX CO., LTD., Tokyo (JP)

(72) Inventors: Motoki Matsushima, Kanagawa (JP); Atsushi Funada, Kanagawa (JP); Taiyou Uehara, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/718,150

(22) Filed: Sep. 28, 2017

(30) Foreign Application Priority Data

Feb. 15, 2017 (JP) ..... 2017-026192

(51) Int. Cl.
*G03G 15/08* (2006.01)

(52) U.S. Cl.
CPC ..... *G03G 15/087* (2013.01); *G03G 15/0889* (2013.01); *G03G 15/0891* (2013.01)

(58) Field of Classification Search
USPC ..... 399/119, 120, 252–256, 258, 260, 262, 399/263
See application file for complete search history.

(56) References Cited

U.S. PATENT DOCUMENTS 6,259,876 B1 * 7/2001 Fukuda ..... G03G 15/0822 399/254
8,213,836 B2 7/2012 Kato et al.
9,829,830 B2 * 11/2017 Sasaki ..... G03G 15/0893
9,835,979 B2 * 12/2017 Suenami ..... G03G 15/0893

FOREIGN PATENT DOCUMENTS

JP 2009-198760 A 9/2009
JP 2011-175095 A 9/2011
JP 2016-061962 A 4/2016

* cited by examiner

*Primary Examiner* — Hoan Tran
(74) *Attorney, Agent, or Firm* — Sughrue Mion, PLLC

(57) ABSTRACT

A developing device includes a rotary member delivering a developer to a latent image on an image carrier while rotating, a supply member disposed in a supply path and including a supply shaft and a helical or substantially helical supply blade, the supply member supplying the developer to the rotary member while rotating, a stirring member disposed in a stirring path, which extends alongside the supply path, and including a stirring shaft and a helical or substantially helical stirring blade, the stirring member stirring and circulating the developer between the supply and stirring paths while rotating, and an ejection path connected to an upstream portion of the supply path in a transport direction of the developer to eject the developer to the outside. The stirring blade's outer diameter is 1.1 or about 1.1 times or more and 1.5 or about 1.5 times or less the supply blade's outer diameter.

8 Claims, 10 Drawing Sheets

DEVELOPING DEVICE AND IMAGE FORMING APPARATUS

CROSS-REFERENCE TO RELATED APPLICATIONS

This application is based on and claims priority under 35 USC 119 from Japanese Patent Application No. 2017-026192 filed Feb. 15, 2017.

BACKGROUND

(i) Technical Field

The present invention relates to a developing device and an image forming apparatus.

(ii) Related Art

A supply member that supplies a developer to a developing roller while rotating is disposed in a supply path along which the developer, which is to be supplied to the developing roller, is transported, and a stirring member that stirs the developer while rotating is disposed in a stirring path extending alongside the supply path. The supply member and the stirring member, which rotate, circulate the developer between the supply path and the stirring path.

The supply member includes a supply shaft having a columnar shape and a supply blade formed in a helical manner on the outer circumferential surface of the supply shaft. The stirring member includes a stirring shaft having a columnar shape and a stirring blade formed in a helical manner around the stirring shaft. The outer diameter of the supply blade and the outer diameter of the stirring blade are equal to each other.

When there are large fluctuations in the surface (liquid surface) of the developer, which is delivered from the stirring member to the supply member, the amount of the developer supplied to the developing roller by the supply member varies. As a result, for example, a developing failure such as an auger mark (unevenness in the density of the developer in a striped pattern generated on an image due to a failure of stirring the developer in a developing device) occurs.

SUMMARY

According to an aspect of the invention, there is provided a developing device including a rotary member that delivers a developer to a latent image on an image carrier while rotating, a supply member that is disposed in a supply path extending in an axial direction of the rotary member and that includes a supply shaft extending in the axial direction and a helical or substantially helical supply blade formed on the supply shaft, the supply member being configured to supply the developer to the rotary member while rotating, a stirring member that is disposed in a stirring path extending alongside the supply path and that includes a stirring shaft extending in the axial direction and a helical or substantially helical stirring blade formed on the stirring shaft, the stirring member being configured to stir and circulate the developer between the supply path and the stirring path while rotating, and an ejection path that is connected to an upstream portion of the supply path in a direction in which the developer is transported and that is used for ejecting the developer to outside. An outer diameter of the stirring blade is 1.1 or about 1.1 times or more and 1.5 or about 1.5 times or less an outer diameter of the supply blade.

BRIEF DESCRIPTION OF THE DRAWINGS

An exemplary embodiment of the present invention will be described in detail based on the following figures, wherein.

DETAILED DESCRIPTION

Figure 1:
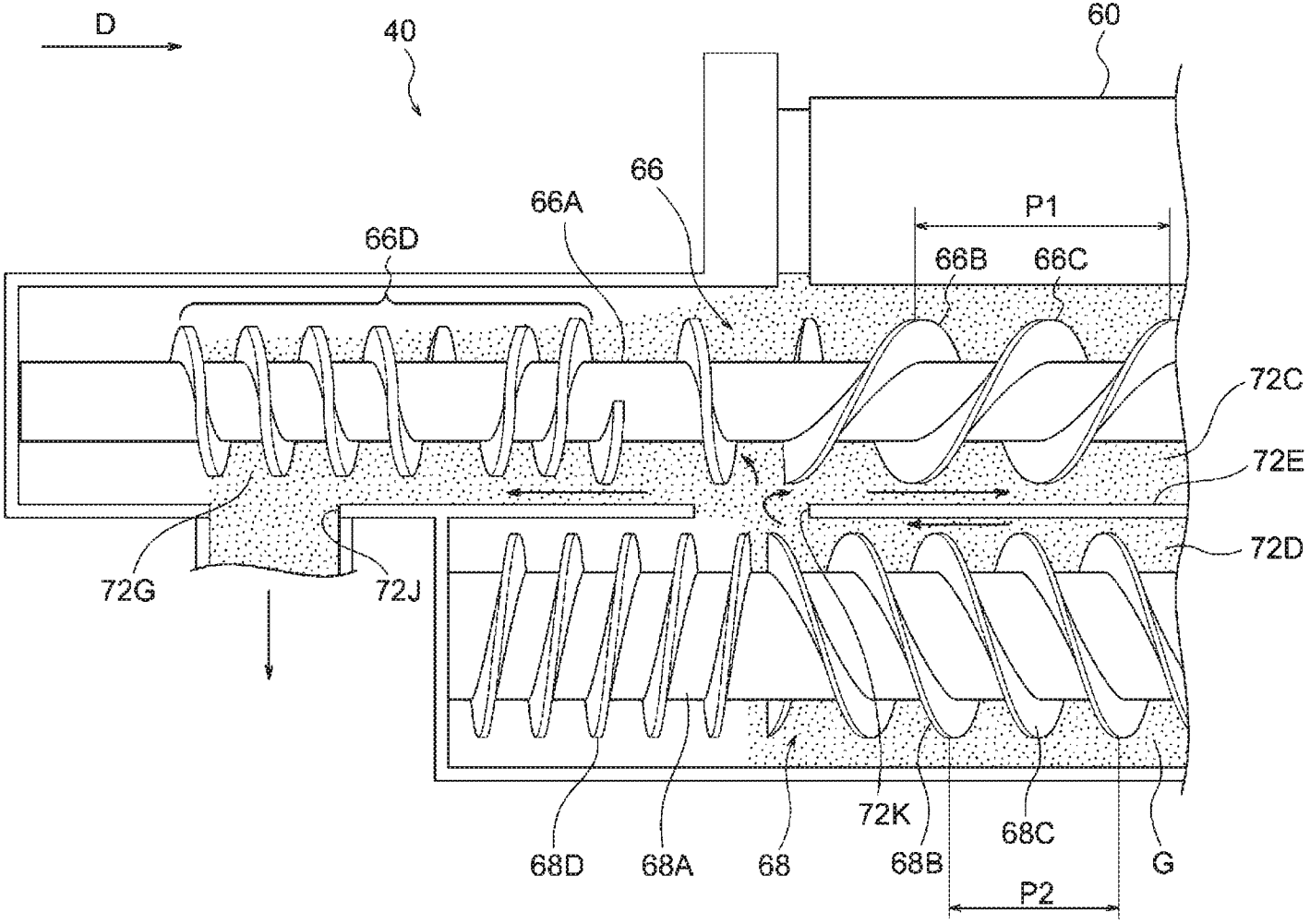
FIG. 1 is an enlarged view of a developing device according to an exemplary embodiment of the present invention.

An example of a developing device and an image forming apparatus according to an exemplary embodiment of the present invention will be described with reference to FIG. 1 to FIG. 10. Note that, arrow H, arrow W, and arrow D that are illustrated in the drawings respectively indicate a top-bottom direction of the image forming apparatus (the vertical direction), a width direction of the image forming apparatus (a horizontal direction), and a depth direction of the image forming apparatus (a horizontal direction).

(Overall Configuration of Image Forming Apparatus)

Figure 4:
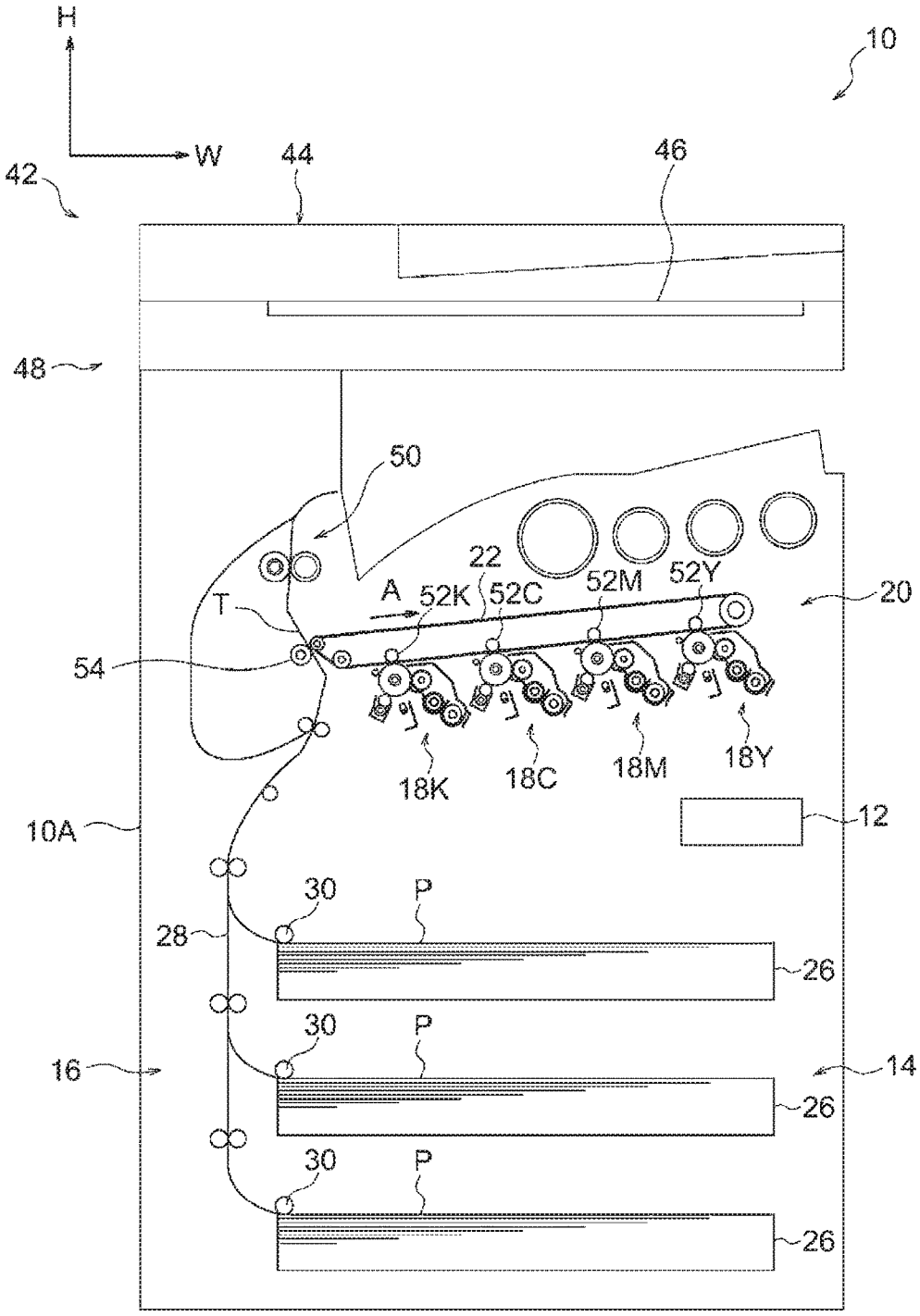
FIG. 4 is a schematic diagram illustrating an image forming apparatus according to the exemplary embodiment of the present invention.

As illustrated in FIG. 4, an image forming apparatus 10 according to the present exemplary embodiment includes an accommodating unit 14 in which sheet members P serving as recording media are accommodated and a transport unit 16 that transports the sheet members P accommodated in the accommodating unit 14. The image forming apparatus 10 further includes an image forming unit 20 that performs an image forming operation on one of the sheet members P transported from the accommodating unit 14 by the transport unit 16, a document reading unit 42 that reads a document, and a controller 12 that controls each of the units.

[Accommodating Unit]

The accommodating unit 14 includes three accommodating members 26 each of which is capable of being drawn out from an apparatus body 10A of the image forming apparatus 10 toward a near side in a depth direction of the image forming apparatus 10 (hereinafter referred to as apparatus depth direction), and the sheet members P are stacked on the accommodating members 26. Each of the accommodating members 26 is provided with a delivery roller 30 that sends out one of the sheet members P stacked on the accommodating member 26, the sheet member P being at the top of the sheet members P, to a transport path 28 that is included in the transport unit 16.

[Transport Unit]

The transport unit 16 includes plural transport rollers (with no reference numeral) that transport the sheet members P along the transport path 28, along which the sheet members P are to be transported.

[Document Reading Unit]

The document reading unit 42 includes a document transport device 44 that automatically transports documents one by one and a platen glass 46 that is disposed below the document transport device 44 and on which a single document is to be placed. The document reading unit 42 further includes a document reading unit 48 that reads a document transported by the document transport device 44 or a document placed on the platen glass 46.

[Image Forming Unit]

The image forming unit 20 includes four image forming units 18Y, 18M, 18C, and 18K, which respectively correspond to colors of yellow (Y), magenta (M), cyan (C), and black (K). Note that in the case where it is not necessary to describe the image forming units 18Y, 18M, 18C, and 18K in such a manner as to be distinguished in terms of color, the letters Y, M, C, and K may sometimes be omitted in the following description.

Figure 3:
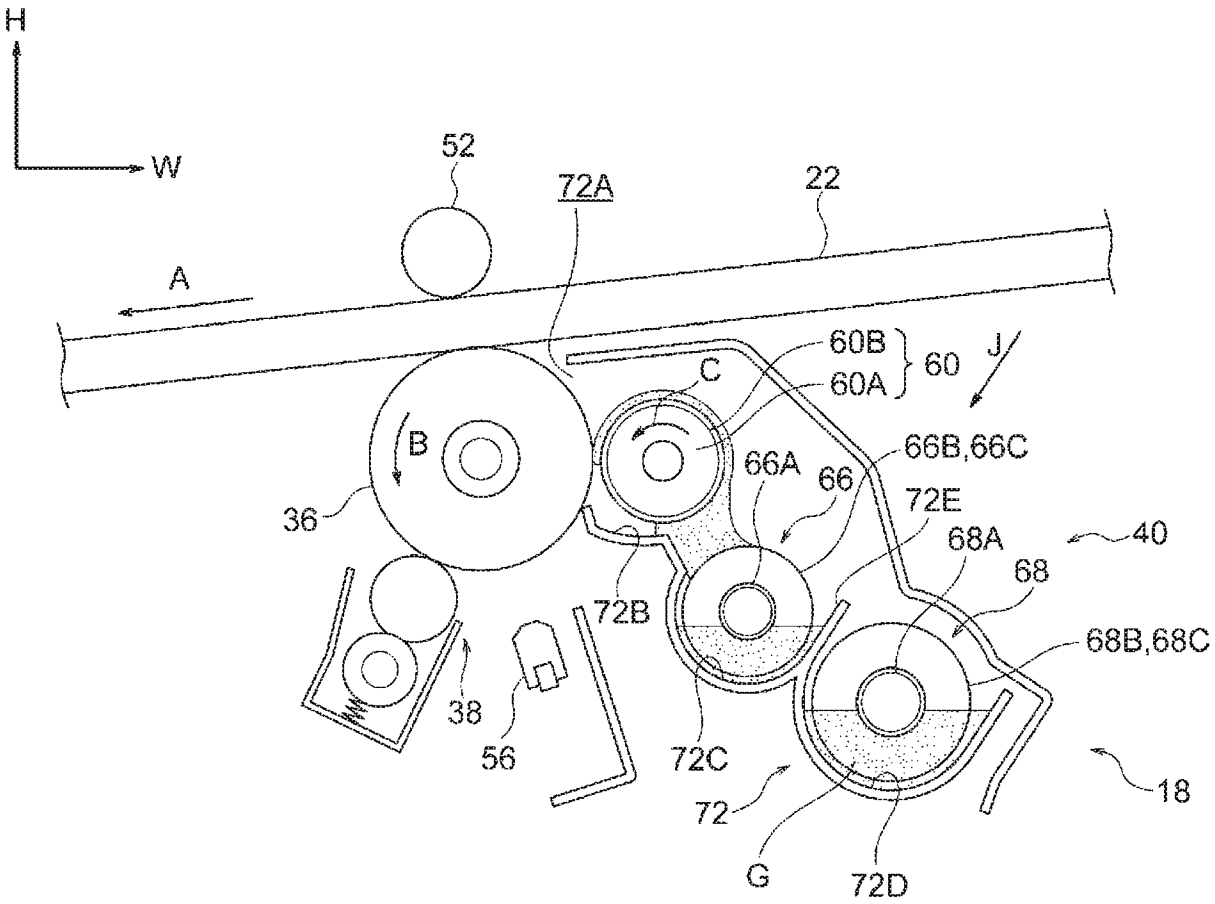
FIG. 3 is a side view illustrating the developing device and the like according to the exemplary embodiment of the present invention.

Each of the image forming units 18 is detachable from the apparatus body 10A. As illustrated in FIG. 3, each of the image forming units 18 includes a photoconductor drum 36 that rotates in the direction of arrow B in FIG. 3 and a charging member 38 that charges a surface of the photoconductor drum 36. Each of the image forming units 18 further includes an exposure device 56 that radiates exposure light onto the charged photoconductor drum 36 and a developing device 40 that develops an electrostatic latent image, which is formed as a result of the exposure light being radiated onto the charged photoconductor drum 36, so as to visualize the electrostatic latent image as a toner image. Each of the photoconductor drums 36 is an example of an image carrier. Note that details of the developing devices 40 will be described later.

As illustrated in FIG. 4, the image forming unit 20 further includes an endless transfer belt 22 that moves circularly in the direction of arrow A in FIG. 4 and first transfer rollers 52 (see FIG. 3) that transfer toner images of the different colors formed by the image forming units 18 onto the transfer belt 22.

The image forming unit 20 further includes a second transfer roller 54 that transfers toner images that have been transferred to the transfer belt 22 onto one of the sheet members P and a fixing device 50 that applies heat and pressure to the sheet member P, to which the toner images have been transferred, so as to fix the toner images onto the sheet member P. The second transfer roller 54 is an example of a transfer device.

(Operation of Image Forming Apparatus)

In the image forming apparatus 10, an image is formed in the following manner.

First, the charging members 38 (see FIG. 3) for the corresponding colors, to each of which a voltage has been applied, uniformly and negatively charge the surfaces of the corresponding photoconductor drums 36 for the different colors to a predetermined electric potential. Next, the exposure devices 56 radiate, on the basis of image data read by the document reading unit 42, the exposure light onto the charged surfaces of the corresponding photoconductor drums 36 for the different colors so as to form electrostatic latent images.

As a result, the electrostatic latent images corresponding to the data are formed on the surfaces of the photoconductor drums 36 for the different colors. In addition, the developing devices 40 for the different colors develop the electrostatic latent images so as to visualize the electrostatic latent images as toner images. The toner images formed on the surfaces of the photoconductor drum 36 for the different colors are sequentially transferred onto the transfer belt 22 by the first transfer rollers 52.

One of the sheet members P that has been sent out to the transport path 28 from one of the accommodating members 26 by a corresponding one of the delivery roller 30 is sent out to a transfer position T at which the transfer belt 22 and the second transfer roller 54 are brought into contact with each other. At the transfer position T, toner images on the transfer belt 22 are transferred onto the sheet member P as a result of the sheet member P being transported between the transfer belt 22 and the second transfer roller 54.

The toner images that have been transferred to the sheet member P are fixed onto the sheet member P by the fixing device 50. Then, the sheet member P, to which the toner images have been fixed, is ejected to outside the apparatus body 10A.

(Configuration of Principal Portion)

Figure 2:
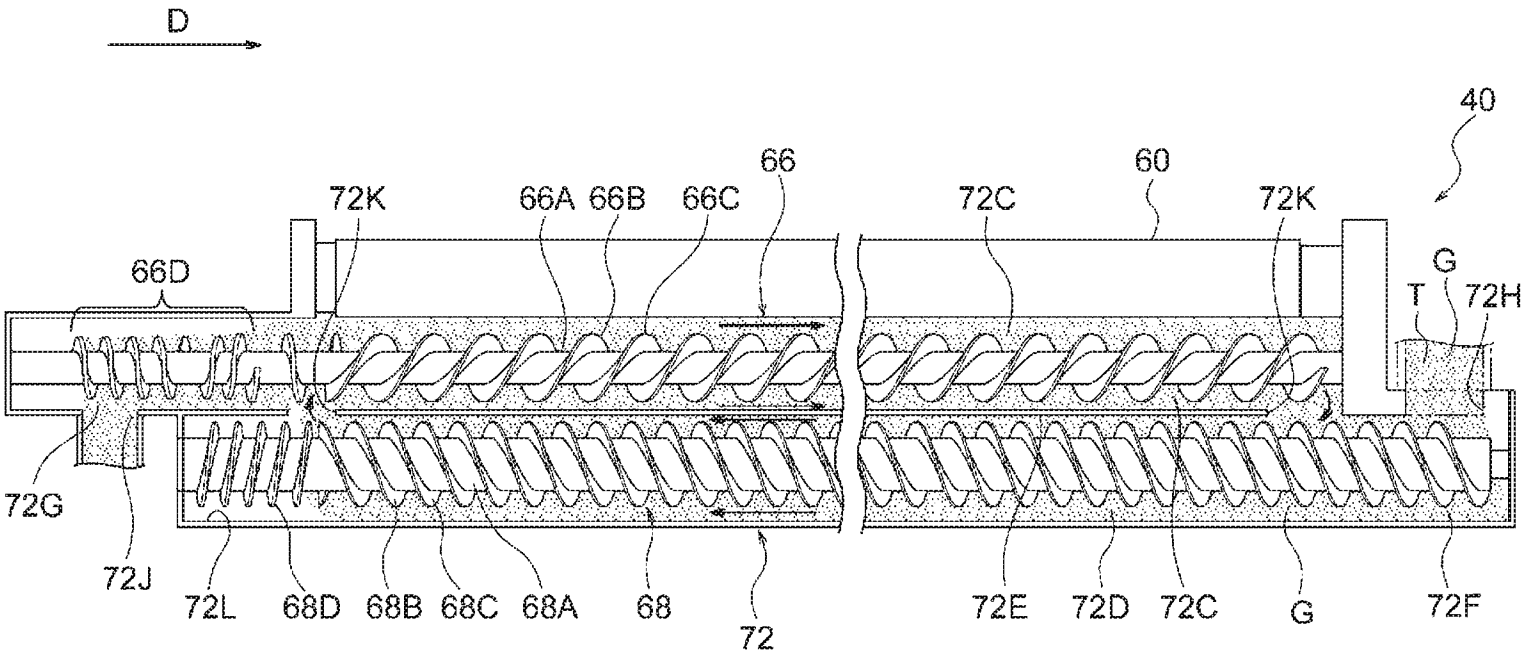
FIG. 2 is a diagram illustrating the developing device according to the exemplary embodiment of the present invention.

The developing devices 40 will now be described. Note that FIG. 1 and FIG. 2 are diagrams each illustrating one of the developing devices 40 illustrated in FIG. 3 when viewed in a direction in which a partition wall 72E of the developing device 40 extends (the direction of arrow J in FIG. 3).

As illustrated in FIG. 3, the developing device 40 includes a housing 72, a developing roller 60 disposed so as to face the photoconductor drum 36, a supply auger 66 that supplies a developer G to the developing roller 60, and a stirring auger 68 that stirs the developer G. The developing roller 60 is an example of a rotary member. The supply auger 66 is an example of a supply member. The stirring auger 68 is an example of a stirring member.

Note that the developer G is a two-component developer containing a toner T and magnetic carrier particles (hereinafter referred to as carrier C).

[Housing]

As illustrated in FIG. 3, the housing 72 is disposed adjacent to the photoconductor drum 36. In the housing 72, an opening 72A that enables access to the interior of the housing 72 is formed at a position facing the photoconductor drum 36 in such a manner as to extend in the apparatus depth direction.

In the housing 72, a delivery path 72B in which the developing roller 60 is disposed is formed in such a manner as to extend in the apparatus depth direction on the side opposite to the side on which the photoconductor drum 36 is disposed with the opening 72A interposed therebetween. In addition, in the housing 72, a supply path 72C in which the supply auger 66 is disposed is formed obliquely below the delivery path 72B in such a manner as to extend in the apparatus depth direction. Furthermore, in the housing 72, a stirring path 72D in which the stirring auger 68 is disposed is formed in such a manner as to extend in the apparatus depth direction on the side opposite to the side on which the delivery path 72B is disposed with the supply path 72C interposed therebetween. In the housing 72, the partition wall 72E is formed between the supply path 72C and the stirring path 72D so as to isolate the supply path 72C and the stirring path 72D from each other.

As illustrated in FIG. 2, in the housing 72, a replenishment path 72F in which the stirring auger 68 is disposed, the replenishment path 72F being used for replenishing the developing device 40 with the toner T and the carrier C, is formed on a far side in the apparatus depth direction (right side in FIG. 2) with respect to the stirring path 72D. The replenishment path 72F is formed by extending the stirring path 72D toward the far side in the apparatus depth direction. In the housing 72, an auxiliary path 72L in which the stirring auger 68 is disposed is formed on the near side in the apparatus depth direction (left side in FIG. 2) with respect to the stirring path 72D. The auxiliary path 72L is formed by extending the stirring path 72D toward the near side in the apparatus depth direction.

In the housing 72, an ejection path 72G in which the supply auger 66 is disposed, the ejection path 72G being used for ejecting the developer G from the developing device 40 is formed on the near side in the apparatus depth direction (left side in FIG. 2) with respect to the supply path 72C. The ejection path 72G is formed by extending the supply path 72C toward the near side in the apparatus depth direction.

—Supply Path, Stirring Path, and Partition Wall—

As illustrated in FIG. 3, each of the supply path 72C and the stirring path 72D is substantially U-shaped when viewed in cross section. The partition wall 72E extends obliquely upward when viewed in the apparatus depth direction and, as illustrated in FIG. 2, isolates the supply path 72C and the stirring path 72D from each other with the exception of a portion of the supply path 72C on the far side in the apparatus depth direction and a portion of the supply path 72C on the near side in the apparatus depth direction. In the housing 72, communication paths 72K that enable the supply path 72C and the stirring path 72D to communicate with each other are formed in the portion of the supply path 72C on the far side in the apparatus depth direction and in the portion of the supply path 72C on the near side in the apparatus depth direction.

—Replenishment Path—

As described above, the replenishment path 72F is formed by extending the stirring path 72D toward the far side in the apparatus depth direction. In addition, in the housing 72, a replenishment port 72H is formed in an upper portion of the replenishment path 72F.

In the above-described configuration, the toner T and the carrier C, with which the developing device 40 is replenished, are injected into the replenishment path 72F via the replenishment port 72H.

—Ejection Path—

As described above, the ejection path 72G is formed by extending the supply path 72C toward the near side in the apparatus depth direction. In addition, in the housing 72, an ejection port 72J is formed in a lower portion of the ejection path 72G as illustrated in FIG. 1.

In the above-described configuration, the developer G that is ejected from the developing device 40 is ejected to outside the developing device 40 via the ejection port 72J.

[Developing Rollers]

As described above, each of the developing rollers 60 is disposed in the corresponding delivery path 72B. In addition, as illustrated in FIG. 3, a gap (development gap) for delivering the developer G from the developing roller 60 to the corresponding photoconductor drum 36 is formed between the developing roller 60 and the photoconductor drum 36.

Each of the developing rollers 60 includes a magnet roller 60A having a circular cross section and a rotary sleeve 60B that is disposed over the magnet roller 60A and that rotates around the magnet roller 60A. The rotary sleeve 60B receives a force from a driving source (not illustrated) that causes the rotary sleeve 60B to rotate and rotates in the direction of arrow C in FIG. 3 (counterclockwise direction).

[Supply Augers]

As described above, each of the supply augers 66 is disposed in the corresponding supply path 72C and the corresponding ejection path 72G. As illustrated in FIG. 2, the supply auger 66 includes a supply shaft 66A extending in the apparatus depth direction, two rows of supply blades 66B and 66C formed in a helical or substantially helical manner on the outer circumferential surface of the supply shaft 66A, and a blade portion 66D that includes plural helical blades, which are formed in a helical manner.

The ends of the supply shaft 66A are rotatably supported on a wall portion of the housing 72, and a gear (not illustrated) that receives a force from a driving source that causes the gear to rotate is fixed at one of the ends of the supply shaft 66A. In the present exemplary embodiment, as an example, the outer diameter of the supply shaft 66A is set to 8 mm.

The two rows of supply blades 66B and 66C are formed on portions of the supply shaft 66A located in the supply path 72C. The outer diameter of the supply blade 66B is equal to the outer diameter of the supply blade 66C. In the present exemplary embodiment, as an example, the outer diameter of each of the supply blades 66B and 66C is set to 16 mm. Each of the supply blades 66B and 66C is arranged at a pitch P1 (see FIG. 1), and the pitch P1 is set to 28 mm. The supply blade 66B and the supply blade 66C are arranged in such a manner as to be displaced from each other by half the pitch P1.

As illustrated in FIG. 1 and FIG. 2, the blade portion 66D is formed on a portion of the supply shaft 66A located in the ejection path 72G and includes the plural helical blades (with no reference numeral). More specifically, the blade portion 66D includes a helical blade that is wound in a winding direction that is parallel to a direction in which the supply blades 66B and 66C are wound and a helical blade that is wound in a winding direction opposite to the direction in which the supply blades 66B and 66C are wound. In the present exemplary embodiment, as an example, the outer diameter of each of the helical blades included in the blade portion 66D is set to 16 mm.

In the above-described configuration, the supply auger 66, which rotates, transports the developer G in the supply path 72C from the near side in the apparatus depth direction (left side in FIG. 2) toward the far side in the apparatus depth direction (right side in FIG. 2) while stirring the developer G and supplies the developer G to the developing roller 60. In addition, the supply auger 66, which rotates, delivers the developer G to the stirring auger 68 via one of the communication paths 72K that is located on the far side in the apparatus depth direction.

Furthermore, the blade portion 66D of the supply auger 66, which rotates, transports, from the far side in the apparatus depth direction toward the near side in the apparatus depth direction, a surplus amount of the developer G that has been delivered from the stirring auger 68 to the supply auger 66 via the other of the communication path 72K that is located on the near side in the apparatus depth direction. The developer G transported by the blade portion 66D is ejected to outside the developing device 40 via the ejection port 72J.

[Stirring Auger]

As described above, the stirring auger 68 is disposed in the stirring path 72D, the replenishment path 72F, and the auxiliary path 72L. The stirring auger 68 includes a stirring shaft 68A extending in the apparatus depth direction, two rows of stirring blades 68B and 68C that are formed in a helical or substantially helical manner on the outer circumferential surface of the stirring shaft 68A, and a reversed blade 68D that is formed in a helical manner.

The ends of the stirring shaft 68A are rotatably supported on the wall portion of the housing 72, and a gear (not illustrated) that receives a force from a driving source that causes the gear to rotate is fixed at one of the ends of the stirring shaft 68A. In the present exemplary embodiment, as an example, the outer diameter of the stirring shaft 68A is set to 11 mm, which is 1.38 times the outer diameter of the supply shaft 66A. The number of rotation of the stirring shaft 68A per unit time, the stirring shaft 68A rotating as a result of receiving a force from a driving source that causes the stirring shaft 68A to rotate, is set to 1.33 times the number of rotation of the supply shaft 66A per unit time.

The two rows of stirring blades 68B and 68C are formed on portions of the stirring shaft 68A located in the stirring path 72D and the replenishment path 72F. The outer diameter of the stirring blade 68B is equal to the outer diameter of the stirring blade 68C. In the present exemplary embodiment, as an example, the outer diameter of each of the stirring blades 68B and 68C is set to 20.6 mm, which is 1.29 times or about 1.29 times the outer diameter of each of the supply blades 66B and 66C.

Each of the stirring blades 68B and 68C is arranged at a pitch P2 (see FIG. 1), and the pitch P2 is set to 20 mm. The stirring blade 68B and the stirring blade 68C are arranged in such a manner as to be displaced from each other by half the pitch P2. In the present exemplary embodiment, the pitch P2 of each of the stirring blades 68B and 68C is 0.71 times the pitch P1 of each of the supply blades 66B and 66C.

The reversed blade 68D is formed on a portion of the stirring shaft 68A located in the auxiliary path 72L. A winding direction in which the reversed blade 68D is wound is opposite to a winding direction in which the stirring blades 68B and 68C are wound. In the present exemplary embodiment, as an example, the outer diameter of the reversed blade 68D is set to 20.6 mm.

In the above-described configuration, the stirring blades 68B and 68C of the stirring auger 68, which rotates, transport the toner T that has been injected into the stirring path 72D from the replenishment path 72F and the developer G that has been delivered from the supply auger 66 via the communication path 72K that is located on the far side in the apparatus depth direction while stirring the toner T and the developer G. More specifically, the stirring blades 68B and 68C of the stirring auger 68, which rotates, transport the developer G from the far side in the apparatus depth direction (right side in FIG. 2) toward the near side in the apparatus depth direction (left side in FIG. 2) while stirring the developer G.

In addition, the reversed blade 68D of the stirring auger 68, which rotates, causes the developer G that has been transported by the stirring blades 68B and 68C to flow back. The stirring auger 68, which rotates, delivers the developer G to the supply auger 66 via the communication path 72K that is located on the near side in the apparatus depth direction.

In the manner described above, the developer G circulates between the supply path 72C and the stirring path 72D (see arrows in FIG. 2).

(Configuration and Operation of Principal Portion)

Operation of each of the developing devices 40 will now be described.

In the housing 72 of each of the developing devices 40, as illustrated in FIG. 2, the supply auger 66 and the stirring auger 68, which rotate, stir and circulate the developer G between the supply path 72C and the stirring path 72D (see arrows in FIG. 2). As a result of the developer G being stirred, the toner T and the carrier C in the developer G rub against each other, and the toner T is triboelectrically-charged so as to have a predetermined polarity.

As illustrated in FIG. 3, the supply auger 66, which rotates, supplies the developer G to the developing roller 60. The developer G supplied to the developing roller 60 is held in a state of forming a magnetic brush (not illustrated) on a surface of the developing roller 60 by using the magnetic force of the magnet roller 50A. The rotary sleeve 60B, which rotates, transports the developer G.

The rotary sleeve 60B, which rotates, transports the developer G to a position facing the photoconductor drum 36. Then, the toner T, which is included in the developer G that has been transported to the position facing the photoconductor drum 36, is deposited onto an electrostatic latent image that has been formed on the photoconductor drum 36, and as a result, the electrostatic latent image is visualized as a toner image.

In the manner described above, when the controller 12 (see FIG. 4) receives, from a detector (not illustrated), information indicating that the toner T in the developer G that circulates between the supply path 72C and the stirring path 72D has decreased, the controller 12 causes the toner T contained in a container (not illustrated) to be injected into the replenishment path 72F via the replenishment port 72H (see FIG. 2).

In contrast, as illustrated in FIG. 1, the blade portion 66D of the supply auger 66, which rotates, transports an amount of the developer G in the housing 72 of the developing device 40 that is in excess of a predetermined amount. More specifically, the blade portion 66D of the supply auger 66, which rotates, transports, from the far side in the apparatus depth direction toward the near side in the apparatus depth direction, a surplus amount of the developer G that has been delivered from the stirring auger 68 via one of the communication paths 72K. The developer G transported by the blade portion 66D is ejected to outside the developing device 40 via the ejection port 72J.

In the manner described above, when the controller 12 (see FIG. 4) receives, from the detector (not illustrated), information regarding the developer G ejected via the ejection port 72J, the controller 12 causes the developer G contained in the container to be injected into the replenishment path 72F via the replenishment port 72H.

[Evaluation-1]

Evaluation results obtained by evaluating a developing device 100 according to a comparative example and one of the developing devices 40 according to the present exemplary embodiment by using a finite element method simulation will be described below. More specifically, evaluation results obtained by evaluating the pressure of the developer G transported in the developing device 40 and the pressure of the developer G transported in the developing device 100 will now be described. First, the configuration of the developing device 100 will be described. Portions of the developing device 100 different from those of the developing device 40 will be described.

—Configuration of Developing Device 100—

Figure 10:
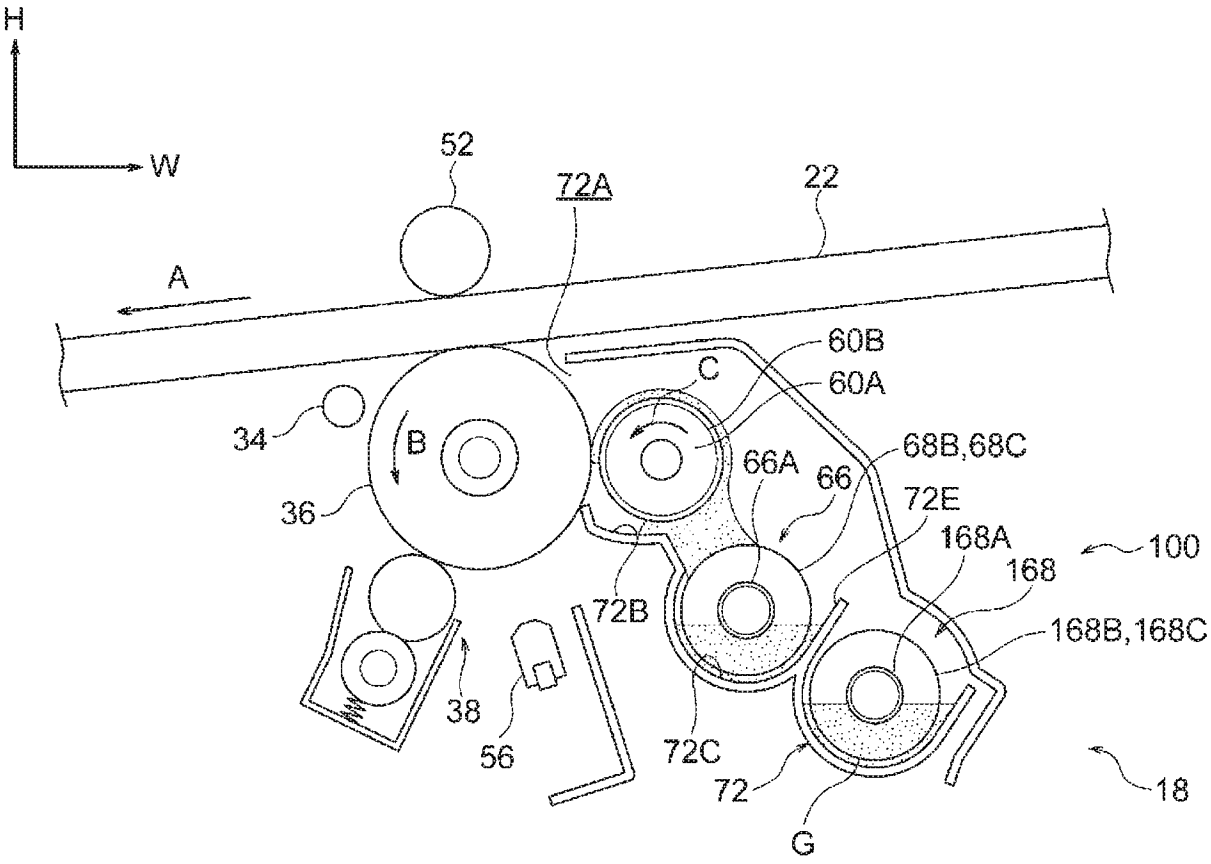
FIG. 10 is a side view of the developing device according to the comparative example of the exemplary embodiment of the present invention.

As illustrated in FIG. 10, a stirring auger 168 of the developing device 100 includes a stirring shaft 168A extending in a depth direction of the developing device 100 (hereinafter referred to as device depth direction), two rows of stirring blades 168B and 168C, and a helical reversed blade (not illustrated). Each of the stirring blades 168B and 168C are formed in a helical or substantially helical manner on the outer circumferential surface of the stirring shaft 168A.

The outer diameter of the stirring shaft 168A is equal to the outer diameter of the supply shaft 66A. The outer diameter of each of the stirring blades 168B and 168C is equal to the outer diameter of each of the supply blades 66B and 66C. Each of the stirring blades 168B and 168C is arranged at a pitch equal to the pitch P1 at which each of the supply blades 66B and 66C is arranged. The number of rotation of the stirring auger 168 is equal to the number of rotation of the supply auger 66.

—Evaluation Results—

Figure 8A:
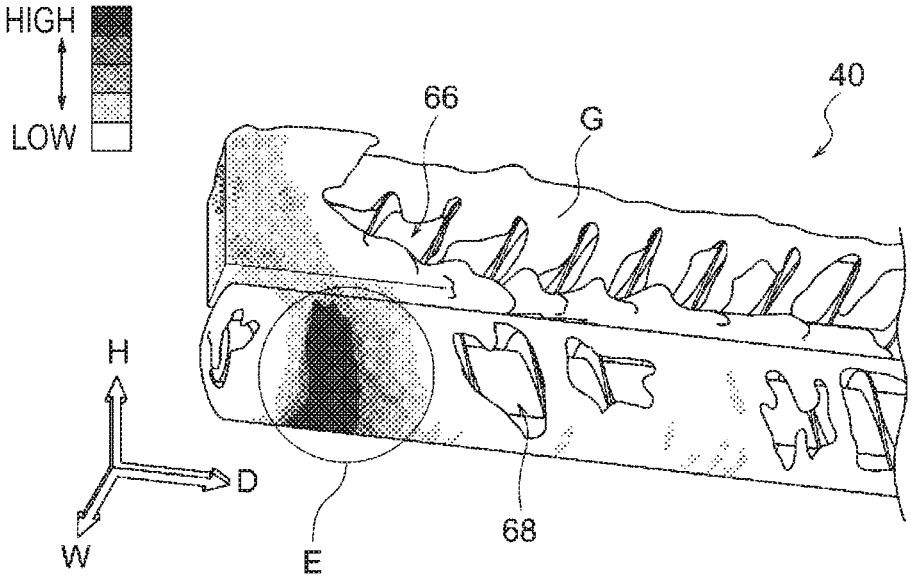
FIGS. 8A and 8B are diagrams illustrating evaluation results of the developing device according to the exemplary embodiment of the present invention.

In FIG. 8A, the pressure of the developer G that is transported in the developing device 40 is indicated by half-tone shading. More specifically, the pressure of the developer G in the case where the pressure of an amount of the developer G that is delivered to the supply auger 66 from the stirring auger 68 (the pressure of the developer G in a portion E) is lowest is indicated by half-tone shading.

Figure 8B:
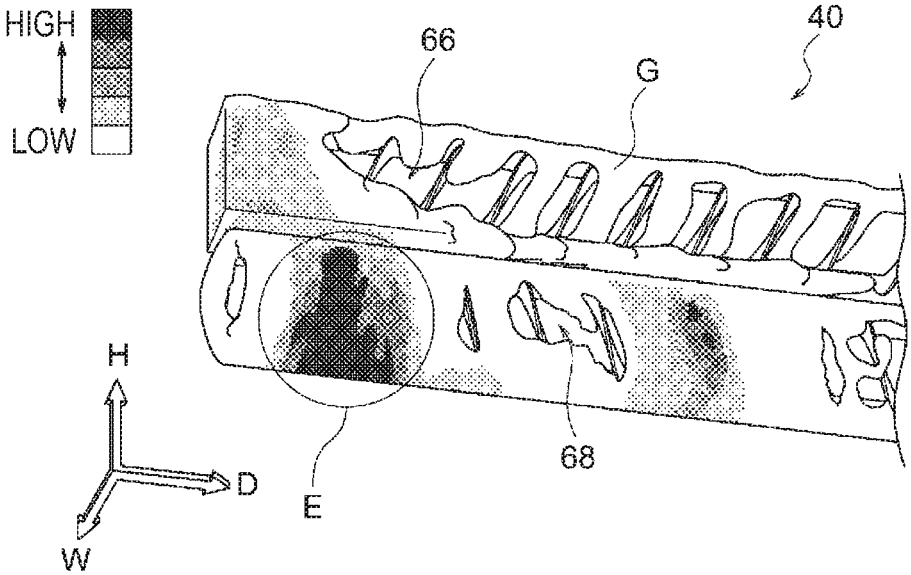

In FIG. 8B, the pressure of the developer G that is transported in the developing device 40 is indicated by half-tone shading. More specifically, the pressure of the developer G in the case where the pressure of an amount of the developer G that is delivered to the supply auger 66 from the stirring auger 68 (the pressure of the developer G in the portion E) is highest is indicated by half-tone shading.

Figure 9A:
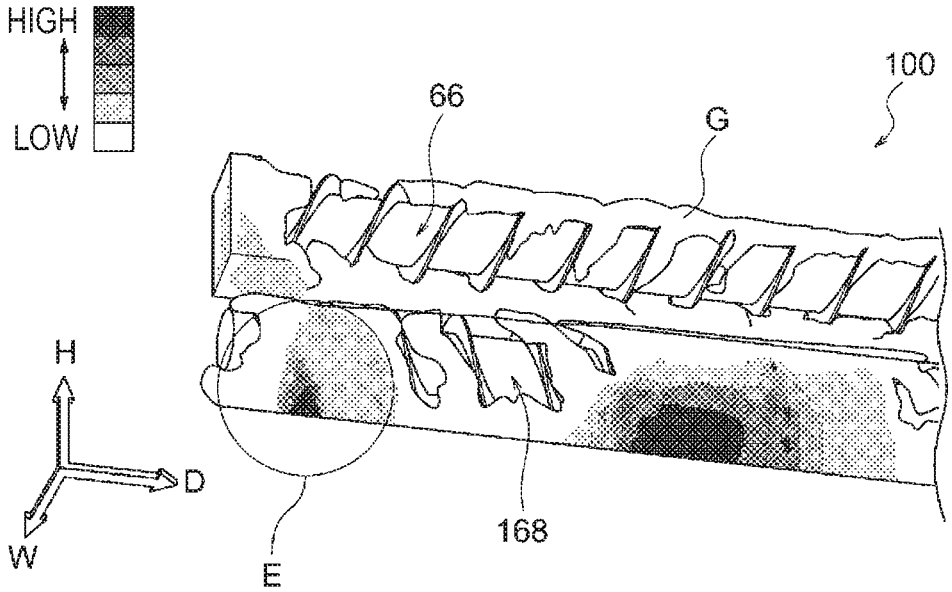
FIGS. 9A and 9B are diagrams illustrating evaluation results of a developing device according to a comparative example of the exemplary embodiment of the present invention.

In FIG. 9A, the pressure of the developer G that is transported in the developing device 100 is indicated by half-tone shading. More specifically, the pressure of the developer G in the case where the pressure of an amount of the developer G that is delivered to the supply auger 66 from the stirring auger 168 (the pressure of the developer G in a portion E) is lowest is indicated by half-tone shading.

Figure 9B:
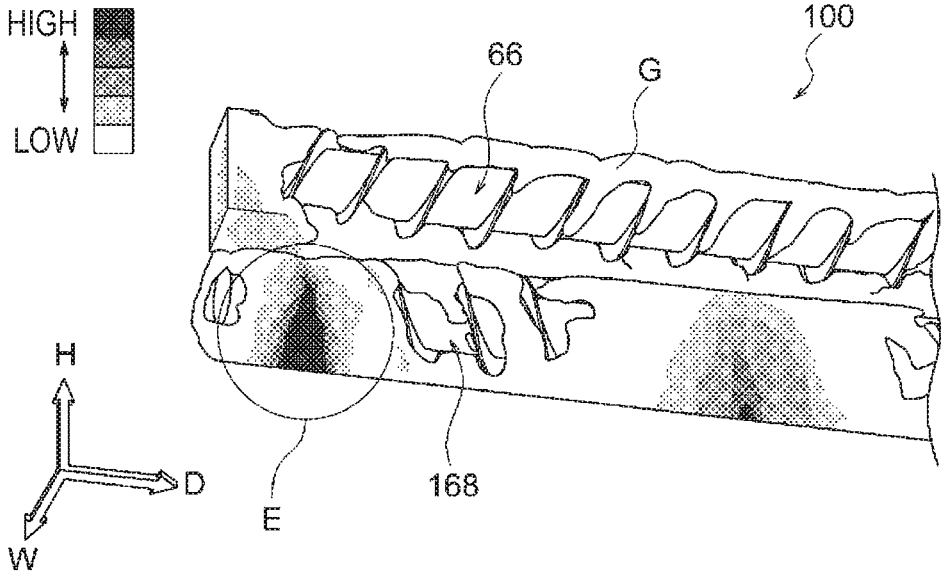

In FIG. 9B, the pressure of the developer G that is transported in the developing device 100 is indicated by half-tone shading. More specifically, the pressure of the developer G in the case where the pressure of an amount of the developer G that is delivered to the supply auger 66 from the stirring auger 168 (the pressure of the developer G in the portion E) is highest is indicated by half-tone shading.

In FIG. 8A to FIG. 9B, the denser the half-tone shading, the higher the pressure of the developer G.

As illustrated in FIG. 8A to FIG. 9B, regarding the pressure of the developer G that is delivered to the supply auger 66 from the stirring auger 68 and the pressure of the developer G that is delivered to the supply auger 66 from the stirring auger 168, it is understood that, in the case of using the developing device 40, a region in which the density of the developer G is high is larger than that in the case of using the developing device 100.

In addition, it is understood that, in the case of using the developing device 40, the degree of pressure fluctuations that occur in the developer G (the amount of change in the region where the half-tone shading is dense) is smaller than that in the case of using the developing device 100.

[Evaluation-2]

Next, evaluation results obtained by evaluating the developer G in the developing device 40 by changing the outer diameter of each of the stirring blades 68B and 68C of the stirring auger 68 of the developing device 40 in a finite element method simulation will be described below.

Figure 5:
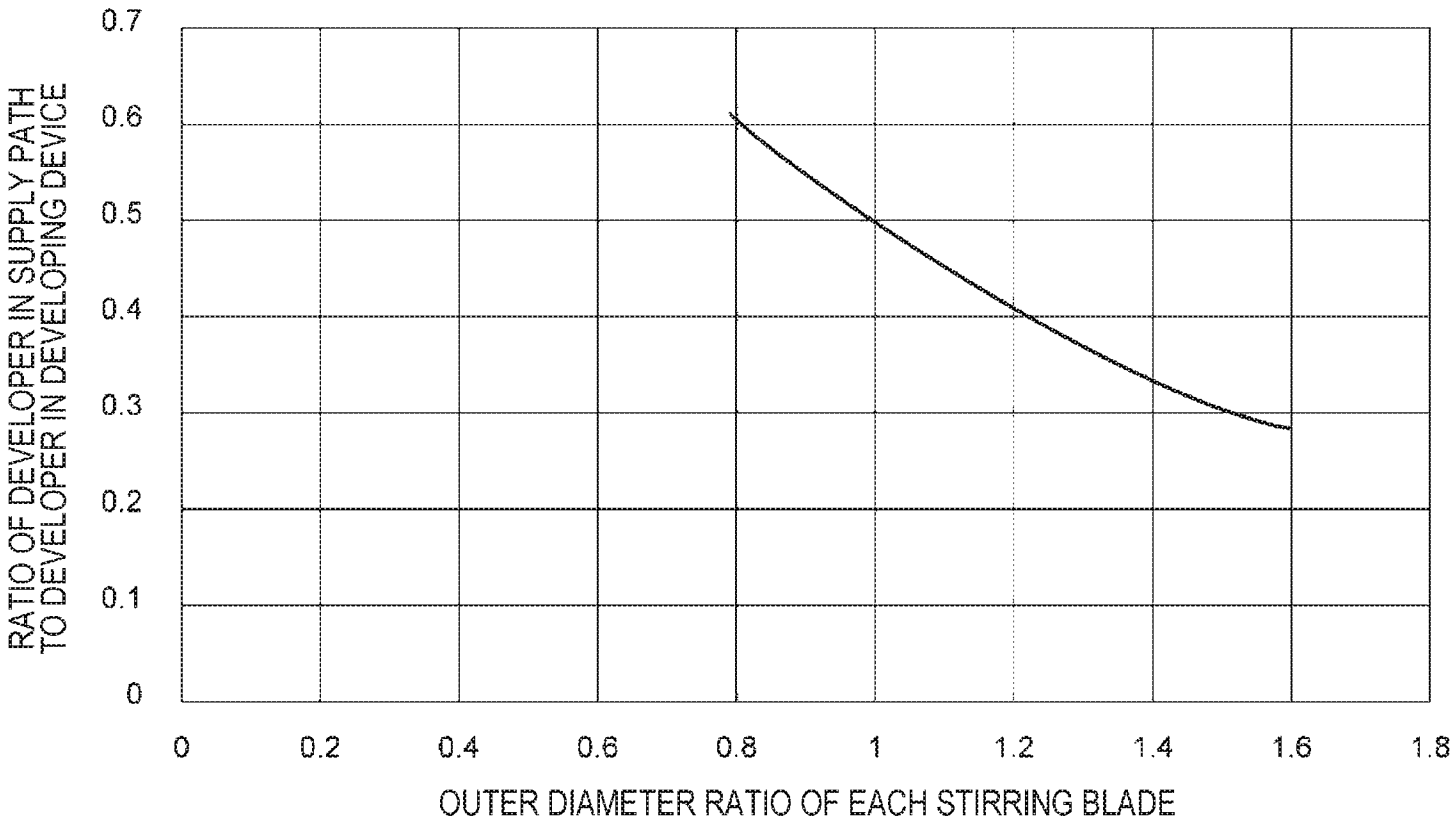
FIG. 5 is a graph illustrating evaluation results of the developing device according to the exemplary embodiment of the present invention.

FIG. 5 is a graph illustrating the ratio of the developer G transported in the supply path 72C to the developer G transported in the developing device 40. The horizontal axis of the graph illustrated in FIG. 5 denotes the value obtained by dividing the outer diameter of each of the stirring blades 68B and 68C by the outer diameter of each of the supply blades 66B and 66C. In other words, when the value (hereinafter referred to as "outer diameter ratio of each of the stirring blades") is equal to one, the outer diameter of each of the stirring blades 68B and 68C and the outer diameter of each of the supply blades 66B and 66C are equal to each other. When the outer diameter ratio of each of the stirring blades is greater than one, the outer diameter of each of the stirring blades 68B and 68C is larger than the outer diameter of each of the supply blades 66B and 66C. When the outer diameter ratio of each of the stirring blades is less than one, the outer diameter of each of the stirring blades 68B and 68C is smaller than the outer diameter of each of the supply blades 66B and 66C.

The vertical axis of the graph illustrated in FIG. 5 denotes the ratio of the developer G transported in the supply path 72C to the developer G transported in the developing device 40. That is to say, the vertical axis of the graph illustrated in FIG. 5 denotes the value obtained by dividing the amount of the developer G transported in the supply path 72C by the amount of the developer G transported in the developing device 40. The larger the value (hereinafter referred to as "ratio of the developer in the supply path"), the larger the amount of the developer G transported in the supply path 72C. In other words, the larger the ratio of the developer in the supply path, the larger the amount of the developer G supplied to the developing roller 60.

It is understood from the graph illustrated in FIG. 5 that the smaller the outer diameter ratio of each of the stirring blades, the larger the ratio of the developer in the supply path.

Figure 6:
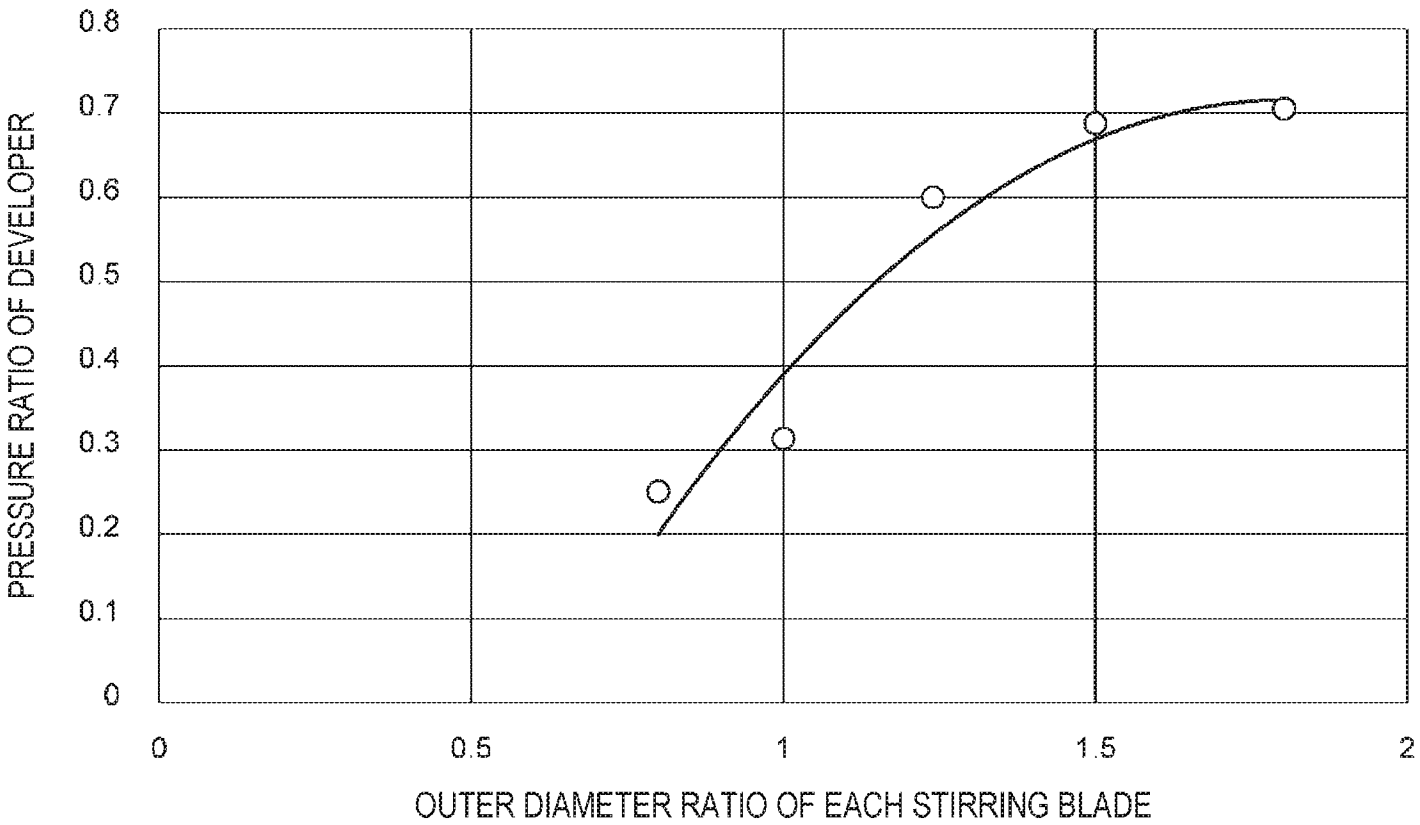
FIG. 6 is a graph illustrating evaluation results of the developing device according to the exemplary embodiment of the present invention.

In contrast, the graph in FIG. 6 illustrates the ratio of the pressure of the developer G delivered to the supply auger 66 from the stirring auger 68 (the developer G in the portion E).

The horizontal axis of the graph illustrated in FIG. 6 denotes the outer diameter ratio of each of the stirring blades. The vertical axis of the graph illustrated in FIG. 6 denotes the ratio of the pressure of the developer G delivered to the supply auger 66 from the stirring auger 68 (hereinafter referred to as "pressure ratio of the developer"). More specifically, the vertical axis of the graph illustrated in FIG. 6 denotes the value obtained by dividing the pressure value in the case where the pressure of the developer G delivered to the supply auger 66 from the stirring auger 68 is lowest by the pressure value in the case where the pressure of the developer G delivered to the supply auger 66 from the stirring auger 68 is highest. The larger the pressure ratio of the developer, the smaller the degree of pressure fluctuations.

It is understood from the graph illustrated in FIG. 6 that the larger the outer diameter ratio of each of the stirring blades, the larger the pressure ratio of the developer.

Figure 7:
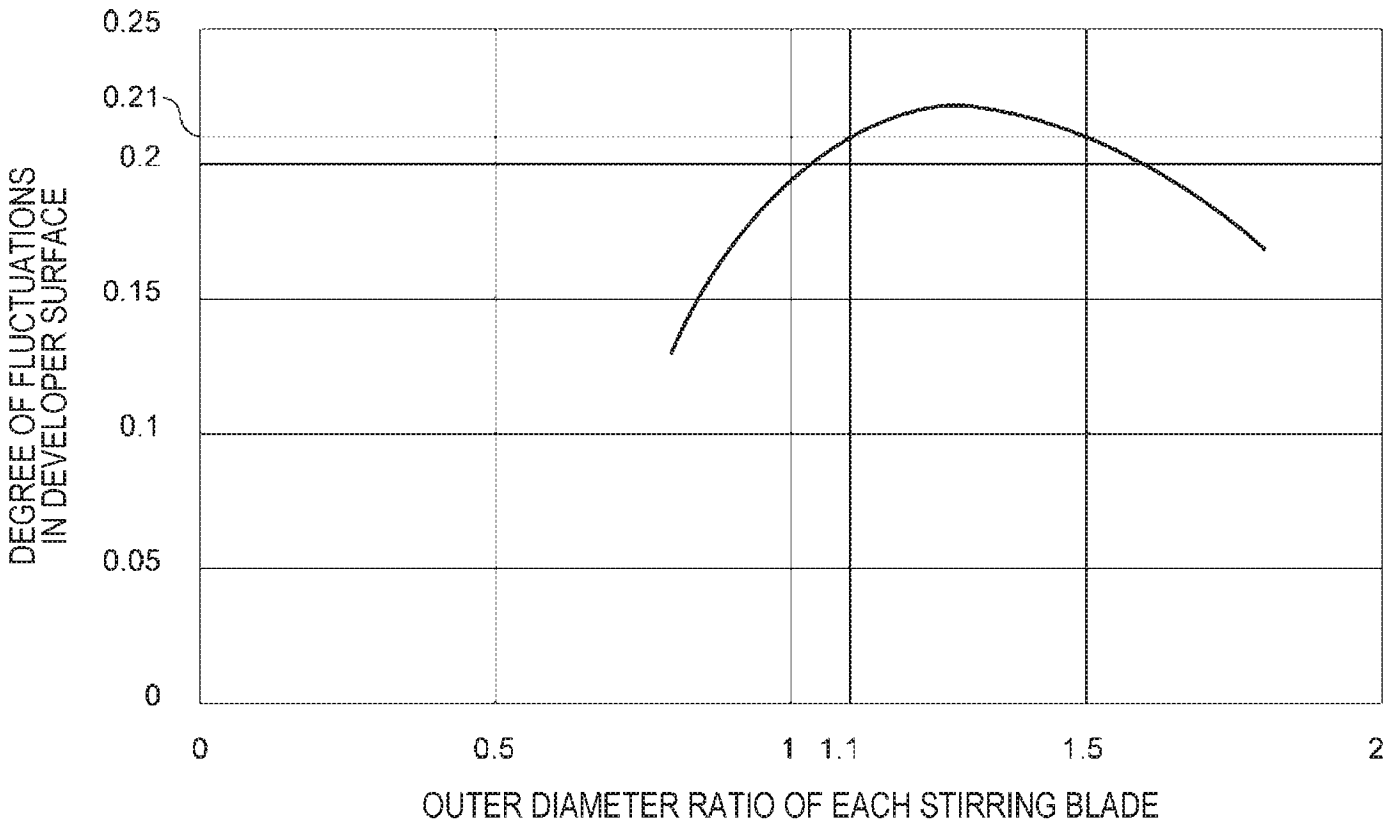
FIG. 7 is a graph illustrating evaluation results of the developing device according to the exemplary embodiment of the present invention.

In contrast, the graph in FIG. 7 illustrates the degree of fluctuations in the surface (liquid surface) of the developer G delivered to the supply auger 66 from the stirring auger 68

(the developer G in the portion E) (hereinafter referred to as "degree of fluctuations in the developer surface").

The vertical axis of the graph illustrated in FIG. 7 denotes the outer diameter ratio of each of the stirring blades. The vertical axis of the graph illustrated in FIG. 7 denotes the degree of fluctuations in the developer surface. More specifically, the degree of fluctuations in the developer surface is the value obtained by multiplying the ratio of the developer in the supply path, which has been mentioned above, by the pressure ratio of the developer, which has been mentioned above.

The larger the degree of fluctuations in the developer surface, the smaller fluctuations in the surface of the developer G delivered to the supply auger 66 from the stirring auger 68. In other words, the larger the degree of fluctuations in the developer surface, the smaller the amount of change in the developer G delivered to the supply auger 66 from the stirring auger 68.

It has been found from past experience that, when the degree of fluctuations in the surface of a developer is 0.21 or larger, the probability of occurrence of a developing failure such as an auger mark (unevenness in the density of a developer in a striped pattern generated on an image due to a failure of stirring the developer in a developing device) is reduced.

As seen from the graph illustrated in FIG. 7, when the outer diameter ratio of each of the stirring blades is 1.1 or about 1.1 or greater and 1.5 or about 1.5 or less, the degree of fluctuations in the developer surface is 0.21 or greater. In the present exemplary embodiment, the outer diameter of each of the stirring blades 68B and 68C is set to 20.6 mm, which is 1.29 times or about 1.29 times the outer diameter of each of the supply blades 66B and 66C. In other words, in the present exemplary embodiment, the outer diameter ratio of each of the stirring blades is 1.29 or about 1.29, and the degree of fluctuations in the developer surface is 0.21 or greater.

SUMMARY

As mentioned above, in the present exemplary embodiment, the outer diameter ratio of each of the stirring blades is 1.29 or about 1.29, and the degree of fluctuations in the developer surface is 0.21 or greater. Therefore, the degree of fluctuations in the surface of the developer G delivered to the supply auger 66 from the stirring auger 68 is smaller than that in the case where the outer diameter of each of the stirring blades 68B and 68C is equal to the outer diameter of each of the supply blades 66B and 66C.

As a result of fluctuations in the surface of the developer G delivered to the supply auger 66 being reduced, the probability of the occurrence of a developing failure, such as an auger mark, is reduced, whereas if the outer diameter of each of the stirring blades 68B and 68C is equal to the outer diameter of each of the supply blades 66B and 66C, the probability of the occurrence of a developing failure, such as an auger mark, will not be reduced.

The ejection path 72G used for ejecting the developer G to the outside is formed in such a manner that, when there is a surplus of the developer G delivered to the supply auger 66 from the stirring auger 68, the ejection path 72G ejects the surplus of the developer G to the outside. Therefore, as a result of fluctuations in the surface of the developer G delivered to the supply auger 66 from the stirring auger 68 being reduced, the amount of the developer G that is ejected to the outside through the ejection path 72G becomes stable, whereas if the outer diameter of each of the stirring blades 68B and 68C is equal to the outer diameter of each of the supply blades 66B and 66C, the amount of the developer G that is ejected to the outside through the ejection path 72G will not become stable.

As a result of the amount of the developer G that is ejected to the outside through the ejection path 72G becoming stable, the amount of the developer G transported in the supply path 72C becomes stable, whereas if the outer diameter of each of the stirring blades 68B and 68C is equal to the outer diameter of each of the supply blades 66B and 66C, the amount of the developer G transported in the supply path 72C will not become stable.

As mentioned above, in the present exemplary embodiment, the outer diameter ratio of each of the stirring blades is set to 1.29 or about 1.29. Thus, it is assumed that the amount of the developer G transported in the stirring path 72D becomes greater than the amount of the developer G transported in the supply path 72C, which in turn results in an imbalance between the amount of the developer G transported in the stirring path 72D and the amount of the developer G transported in the supply path 72C. However, since the pitch P2 of each of the stirring blades 68B and 68C is shorter than the pitch P1 of each of the supply blades 66B and 66C, the probability of an imbalance occurring between the amount of the developer G transported in the stirring path 72D and the amount of the developer G transported in the supply path 72C is reduced, whereas if the pitch P2 of each of the stirring blades 68B and 68C is equal to the pitch P1 of each of the supply blades 66B and 66C, the probability of an imbalance occurring between the amount of the developer G transported in the stirring path 72D and the amount of the developer G transported in the supply path 72C will not be reduced.

As a result of the probability of an imbalance occurring between the amount of the developer G transported in the stirring path 72D and the amount of the developer G transported in the supply path 72C being reduced, the probability of the occurrence of a developing failure, such as an auger mark, is reduced, whereas if the pitch P2 of each of the stirring blades 68B and 68C is equal to the pitch P1 of each of the supply blades 66B and 66C, the probability of the occurrence of a developing failure, such as an auger mark, will not be reduced.

As mentioned above, there may be a case where an imbalance occurs between the amount of the developer G transported in the stirring path 72D and the amount of the developer G transported in the supply path 72C. However, since the outer diameter of the stirring shaft 68A is larger than the outer diameter of the supply shaft 66A, the probability of an imbalance occurring between the amount of the developer G transported in the stirring path 72D and the amount of the developer G transported in the supply path 72C is reduced, whereas if the outer diameter of each of the stirring blades 68B and 68C is equal to the outer diameter of each of the supply blades 66B and 66C, the probability of an imbalance occurring between the amount of the developer G transported in the stirring path 72D and the amount of the developer G transported in the supply path 72C will not be reduced.

As a result of the probability of an imbalance occurring between the amount of the developer G transported in the stirring path 72D and the amount of the developer G transported in the supply path 72C being reduced, the probability of the occurrence of a developing failure, such as an auger mark, is reduced, whereas if the outer diameter of each of the stirring blades 68B and 68C is equal to the outer diameter of each of the supply blades 66B and 66C, the probability of the occurrence of a developing failure, such as an auger mark, will not be reduced.

In the image forming apparatus 10, as a result of the probability of the occurrence of a developing failure, such as an auger mark, being reduced, degradation of the quality of an output image is suppressed, whereas if the image forming apparatus 10 does not include the developing devices 40, degradation of the quality of an output image will not be suppressed.

Note that although a specific exemplary embodiment of the present invention has been described in detail, the present invention is not limited to the exemplary embodiment, and it is obvious to those skilled in the art that the present invention may employ other various exemplary embodiments within the scope of the present invention. For example, in the above-described exemplary embodiment, although the two rows of stirring blades 68B and 68C and the two rows of supply blades 66B and 66C are provided, any number of rows of the stirring blades and the supply blades may be provided as long as equal numbers of rows of the stirring blades and the supply blades are provided.

In the above-described exemplary embodiment, although the outer diameter ratio of each of the stirring blades is 1.29 or about 1.29, the outer diameter ratio of each of the stirring blades may be 1.1 or about 1.1 or greater and 1.5 or about 1.5 or less.

In the above-described exemplary embodiment, although the pitch P2 of each of the stirring blades 68B and 68C is shorter than the pitch P1 of each of the supply blades 66B and 66C, the pitch P2 of each of the stirring blades 68B and 68C may be equal to or longer than the pitch P1 of each of the supply blades 66B and 66C. However, in this case, effects that may be obtained by setting the pitch P2 of each of the stirring blades 68B and 68C to be shorter than the pitch P1 of each of the supply blades 66B and 66C will not be obtained.

In the above-described exemplary embodiment, although the outer diameter of the stirring shaft 68A is larger than the outer diameter of the supply shaft 66A, the outer diameter of the stirring shaft 68A may be smaller than the outer diameter of the supply shaft 66A. However, in this case, effects that may be obtained by setting the outer diameter of the stirring shaft 68A to be larger than the outer diameter of the supply shaft 66A will not be obtained.

In the above-described exemplary embodiment, although the blade portion 66D used for ejecting a surplus amount of the developer G is formed in such a manner as to be included in the supply auger 66, a portion of the supply shaft 66A of the supply auger 66 located in the ejection path 72G may be referred to as an ejection shaft, and the blade portion 66D may be formed on the ejection shaft.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a rotary member that delivers a developer to a latent image on an image carrier while rotating;

a supply member that is disposed in a supply path extending in an axial direction of the rotary member and that includes a supply shaft extending in the axial direction and a substantially helical supply blade formed on the supply shaft, the supply member being configured to supply the developer to the rotary member while rotating;

a stirring member that is disposed in a stirring path extending alongside the supply path and that includes a stirring shaft extending in the axial direction and a substantially helical stirring blade formed on the stirring shaft, the stirring member being configured to stir and circulate the developer between the supply path and the stirring path while rotating; and an ejection path that is connected to an upstream portion of the supply path in a direction in which the developer is transported and that is used for ejecting the developer to outside, wherein an outer diameter of the stirring blade is about 1.1 times or more and about 1.5 times or less an outer diameter of the supply blade.

2. The developing device according to claim 1, wherein the stirring blade is arranged at a pitch shorter than a pitch at which the supply blade is arranged.

3. The developing device according to claim 2, wherein an outer diameter of the stirring shaft is larger than an outer diameter of the supply shaft.

4. An image forming apparatus comprising:

the developing device according to claim 3 that develops a latent image formed on the image carrier into a toner image; and a transfer device that transfers the toner image onto a recording medium.

5. An image forming apparatus comprising:

the developing device according to claim 2 that develops a latent image formed on the image carrier into a toner image; and a transfer device that transfers the toner image onto a recording medium.

6. The developing device according to claim 1, wherein an outer diameter of the stirring shaft is larger than an outer diameter of the supply shaft.

7. An image forming apparatus comprising:

the developing device according to claim 6 that develops a latent image formed on the image carrier into a toner image; and a transfer device that transfers the toner image onto a recording medium.

8. An image forming apparatus comprising:

the developing device according to claim 1 that develops a latent image formed on the image carrier into a toner image; and a transfer device that transfers the toner image onto a recording medium.

* * * * *